United States Patent [19]

Asp

[11] 4,064,884

[45] Dec. 27, 1977

[54] METHOD AND DEVICE FOR STRIPPING OFF, WASHING AND DRYING SURFACE TREATED OBJECTS IN LONG LENGTHS SUCH AS STRIP, WIRE, ROD, SECTIONS OR FIBRES

[75] Inventor: Hans Eskil Asp, Hammaro, Sweden

[73] Assignee: C. J. Wennberg AB, Sweden

[21] Appl. No.: 670,432

[22] Filed: Mar. 25, 1976

[30] Foreign Application Priority Data

Mar. 25, 1975 Sweden ..... 7503464

[51] Int. Cl.[2] ..... B08B 1/02

[52] U.S. Cl. ..... 134/15; 134/21; 134/64 R; 134/95; 134/122 R

[58] Field of Search ..... 134/15, 21, 64 R, 95, 134/122 R

[56] References Cited

U.S. PATENT DOCUMENTS

| | | | |
|---|---|---|---|
| 2,509,668 | 5/1950 | Berggren | 134/64 R |
| 3,070,463 | 12/1962 | Barday | 134/15 |
| 3,270,364 | 9/1966 | Steele | 134/122 R |
| 3,938,214 | 2/1976 | Hodsden et al. | 134/64 R |

*Primary Examiner*—Arthur D. Kellogg

*Attorney, Agent, or Firm*—Hill, Gross, Simpson, Van Santen, Steadman, Chiara & Simpson

[57] ABSTRACT

Objects in long lengths such as strip, wire, rod, sections or fibres which have been surface treated in a preceding step are, according to the present invention, liberated from entrained surface treating agent or agents by a method for stripping off said agent or agents, washing and drying said objects, said method being performed continuously and the individual steps viz. the stripping off, the washing and the drying taking place sequentially against the feeding direction of the object in question. Also an apparatus for performing the method is described. The apparatus includes a fluid inlet assembly and a fluid discharge assembly, there being a passage through said assemblies through which the object can pass in an object-feeding direction. Liquid is discharged through a jet nozzle, which surrounds the object, in an opposite direction. The liquid is recirculated, and can be transferred to a station which is prior in treatment.

4 Claims, 4 Drawing Figures

METHOD AND DEVICE FOR STRIPPING OFF, WASHING AND DRYING SURFACE TREATED OBJECTS IN LONG LENGTHS SUCH AS STRIP, WIRE, ROD, SECTIONS OR FIBRES

BACKGROUND OF THE INVENTION

1. Field of the Invention

This invention relates to method and apparatus for cleaning elongated objects after they have been subjected to a surface treatment by a fluid medium.

2. Prior Art

The prior devices used for washing and drying surface treated objects of various materials in long lengths, such as strip, wire, rod and bars or fibres, show drawbacks which are unsatisfactory from technical and economic aspects.

Another disadvantage of prior devices is that technical difficulty and cost in complying with environmental regulations, particularly where contaminating washing agents are concerned, in which often the solvent is a constituent of the surface treating medium.

For achieving an acceptable surface cleanliness for an object, e.g. wire contaminated with acid or alkaline agents from a preceding surface treatment — particularly as these agents have a considerable adherence to the surface of the material — these prior devices are often provided for flushing as well as washing the object by immersion. This usage renders the devices more complicated in their structure and assembly and also requires more space, especially for high feeding speeds of the object, because several washing steps and stations must be used. The prior devices further have a comparatively high consumption of washing agent, a condition which increases the technical and economic investments for regenerating or otherwise treating the contaminated washing agent or agents for environmental protection.

Another factor that affects the content of impurities in the washing agent after its use, is the amount of medium carried by the wire to the washing station, said amount being difficult to control and varying when using the known devices. These conditions are caused by inefficient wiping devices with which these prior devices are provided for acting on the job before the washing. Usually, the wiping devices are felts, tow, or the like. Such methods and devices are unsatisfactory because after a short time of use, the wiping device becomes saturated by the wiped-off medium. The wear on these devices is considerable and causes the amount of medium adhering to the object to vary.

The flushing devices for prior devices require also regular care and maintenance, because the nozzles used will clog within a short period of time. Finally the drying by the prior devices is unsatisfactory. When drying an object after the washing, particularly at high object-feeding speeds moisture remaining on the surface may cause drawbacks, such as discoloration and/or corrosion.

SUMMARY OF THE INVENTION

The method and the device according to the present invention are aimed at overcoming the above mentioned disadvantages while maintaining the necessary environmental protection. This object is obtained by a special construction of the devices for carrying the novel method into effect.

The present invention includes a method for stripping off, washing and drying of elongated objects, such as a strip, wire, rod, bar or fibers, said objects having been surface treated in a fluid medium in one or several preceding steps or stations. The object in a first step or station is sprayed with a liquid being circulated within said station, said liquid being of substantially the same kind as the fluid medium used in the last surface treatment step or station, such spray being directed onto the entire periphery in a direction opposite to the object-feeding direction. The object is then dried within such station. The object in a subsequent step (steps) or station (stations) is sprayed with a more and more diluted liquid and is dried in each station. The used liquid in the final station is transferred to the next preceding station. In the last station or step the liquid substantially is a solvent forming part of the fluid medium.

The liquid circulating in the first washing station can ultimately be returned to the last surface treating station.

During spraying of the object, a partial vacuum is created around the portion of the object which has been sprayed. The partial vacuum is only partially relieved by gas, e.g. air, being sucked in around the emerging object, whereby the material is dried by such gas after the spraying.

The spraying is done by jets from a coherent curtain of liquid impinging on the peripheral surfaces of the object, which curtain forms an impinging angle of 1° to 60°, preferably 20° to 30°, with respect to the longitudinal direction of the object.

The apparatus according to the invention for cleaning an elongated object which has been surface-treated at a station with a fluid medium, comprises a fluid inlet assembly having a jet nozzle, the inlet assembly having a passage extending therethrough with a cross-section larger than that of the object for enabling the object to be passed therethrough in an object-feeding direction, the jets of the nozzle being directed for impinging the object at an angle having a vector opposite to the feeding direction, means for supplying liquid to the jet nozzle of substantially the same type as the fluid medium, and a discharge assembly connected to the fluid inlet assembly through which liquid injected from the jet nozzle is removed, and through which the object passes to said passage.

The inlet assembly and the fluid discharge assembly are interconnected by means of a part which diverges internally from the inlet assembly toward the discharge assembly.

The discharge assembly is provided with an outlet for liquid medium as well as gas, e.g. air, entrained by the liquid.

According to the present invention one or several stations are sequentially arranged and connected to each other. In each station, a circulation tank is connected to the discharge assembly, said tank being provided with a spillway and devices comprising valves for feeding and discharging the liquid and the tank further being connected by conduits provided with valves to the immediately preceding station and the subsequent station.

Thus, several stations can be sequentially connected to constitute a treating line for continuous stripping off, washing and drying of surface treated elongated objects.

The removal of fluid medium and drying can be carried out with gas only, e.g. with air, whereby the fluid medium removed from the surface of the object is returned to the last surface treating station by means of a spillway emptying into the surface treating station from the recirculation tank of said step. If air is used as a stripping means in the first cleaning station after the last surface treating station, a solvent or solvents can be used for washing the object in a subsequently connected station. By simple tests, it can be determined how many consecutive stations are required to obtain a surface on the object dry and free of surface treating medium.

The jet nozzle is so fastened in the inlet assembly, e.g. by threads that a cleaning of the injection ducts can be undertaken even when the device is operating.

When the device is to be used in combination with electrochemical surface treating processes, it is made of an electrically non-conductive material. If desired, means for heating and/or cooling the liquid used in the device can also be provided.

The device according to the invention can be used with horizontal or vertical feeding of the object. The most apparent use for the present invention is in treatment of metal wire, but also glass-fiber can be treated with an adhesion agent, a so-called "anchoring agent", before the fiber in any desired shape is used as a reinforcing material. Such treating agents include silane compounds or complex chromium compounds. In the production of boron fibers, these fibers are often etched for removing surface cracks and for improving their adhesion to the material to be reinforced. The fibers are thus treated with a suitable medium.

DESCRIPTION OF THE DRAWINGS

The device according to the present invention is, however, described in connection with treating of wire according to the attached drawing in which.

AS SHOWN ON THE DRAWINGS

Figure 1:
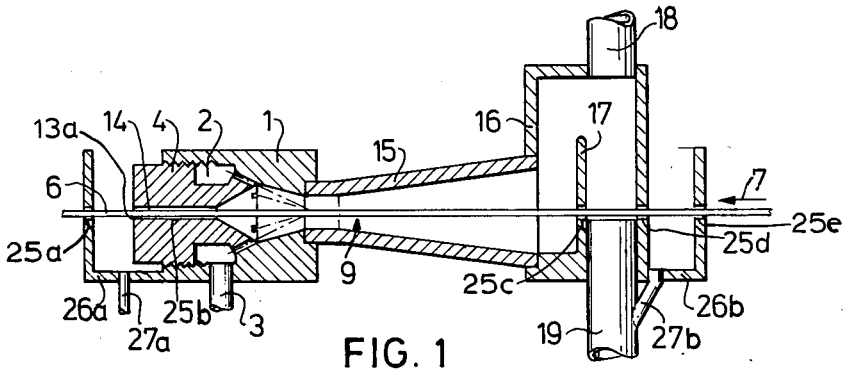
FIG. 1 is a longitudinal cross-sectional view of the device.

The device according to the invention is schematically shown in FIG. 1. The device comprises an inlet assembly 1 made of suitable material, e.g. plastic resin.

The inlet assembly 1 has a distribution chamber 2, e.g. in the form of a pipe or an annular duct to which a liquid is led from a suitable liquid supply by means of an inlet conduit 3.

The liquid supplied through the inlet conduit 3 is, in the distribution chamber 2, evenly distributed to a set of injection ducts 5 forming part of a jet nozzle 4 located in the inlet assembly, the injection ducts 5 leading from the distribution chamber 2 to the discharge end of the jet nozzle 4.

Figure 2:
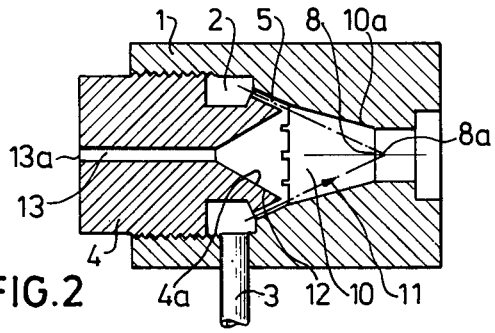
FIG. 2 is an enlarged longitudinal cross-section of the inlet assembly of FIG. 1.

As shown in FIGS. 1 and 2, the jet nozzel 4, is fixed or suitably releasably assembled, e.g. threaded into the inlet assembly 1, and has a conical or wedge-shaped orifice 4*a* for guiding an object 6 in a feeding direction 7 through the device.

The injection ducts 5 of the jet nozzle 4 are dimensioned for injecting a suitable amount of the liquid in a direction opposite to the feeding direction 7 of the object 6, the amount of liquid thereby being adapted to the dimension of the object 6.

The injection ducts 5 are so arranged in the jet nozzle 4 that a number of jets 11 from a curtain of the injected liquid and which impinge in an impinging angle 8 of e.g. 25° to the surfaces of the object 6, whereby the impingement 8*a* takes place on all the surfaces on the circumference of the object.

The jet nozzle 4 has a passage 13, the walls of which, together with the object 6, form an annular gap 14 for aspiration of gas, e.g. air.

As the liquid is injected through the jet nozzle toward the object, a partial pressure is created in a zone 9, which zone extends from the opening 13*a* of the passage 13 along a conical space 12 in the jet nozzle 4, an inner space 10 bounded by the inner conical part 10*a* in the inlet assembly 1, on into a region ahead of the place of impingement 8*a*. The partial pressure strives to be relieved, and thus gas, e.g. air, is sucked in through the gap 14 in the passage 13, whereby the gas moves in direction opposite to the feeding direction 7 of the object 6 and the aspirated gas flows to the space 10*a*, whereafter the gas (the air) mixed with the injected medium after having been in contact with the surfaces of the object enters into an expansion chamber 15 connected to the inlet assembly 1.

The expansion chamber 15 has a wedge-shaped or conical form and in its cross section diverges in a direction opposite to the feeding direction 7 of the object 6. The chamber 15, is at its largest cross-section connected to a discharge assembly 16 arranged for receiving the mixture of gas(air)-liquid coming from the expansion chamber 15.

Figure 3:
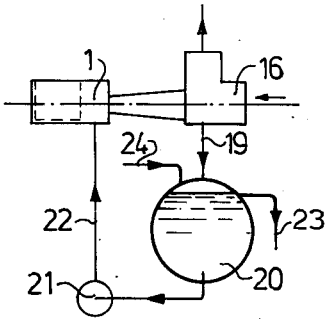
FIG. 3 is a flow diagram for liquid flowing through the device.

The mixture of liquid and gas flows thereafter over a spillway 17 in the discharge assembly 16, whereby a certain degassing of the liquid takes place. The liberated gas is discharged through an evacuating duct 18 located in the discharge assembly 16. Thereafter the liquid is led away by the spillway 17 through a discharge conduit 19 located in the discharge assembly 16 to a circulation tank 20 as shown in FIG. 3. The recirculation tank 20 is provided with devices (not shown) for degassing the liquid and venting of the recirculation tank and is also has a spillway 23 for discharging used liquid as well as with devices 24 for supplying new, unused medium.

As shown in FIG. 3, the liquid is caused to flow from the recirculation tank 20 by a pump 21 through a pipe 22 in the direction of the arrows through the inlet conduit 3, through the distribution chamber 2 and the injection ducts 5 of the jet nozzle 4 in a direction opposite to the feeding direction 7 of the object 6 toward the surfaces of the object 6, and further through the expansion chamber 15 to the discharge assembly, over its spillway 17 and back to the recirculation tank 20 through the discharge conduit 19. Several treating stations according to FIG. 3 - be interconnected to a treating line.

For guiding the object, e.g. a wire, through the device the device contains a number of guides 25*a-e* arranged in the discharge assembly 16 and in the inlet assembly 1.

The inlet assembly 1 and the discharge assembly 16 each have a collecting channel 26*a*, 26*b* having a drain pipe 27*a*, 27*b* for collecting any liquid flowing through the device or any liquid carried by the object, the wire.

Figure 4:
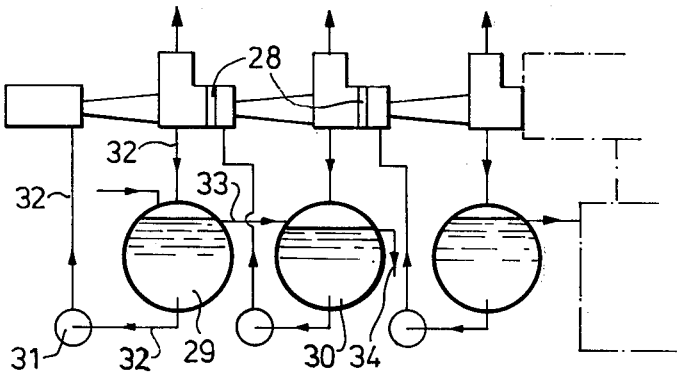
FIG. 4 shows treatment stations, interconnected to form a treating line and including a flow diagram.

The device can be used in a combined treatment, in which a number of devices 28 as shown in FIG. 4 are connected in series for sequential treatment in a treating line for e.g. stripping off, washing and drying, or alternatively several washing steps or stations.

When the device is used in several washing steps or stations, e.g. two, the device has at each washing station a separate recirculation tanks 29, 30, each having a pump 31 and a conduit 32 independently forming a closed recirculation path for washing water or solvent. The tank 29 has a spillway 33 opening into the recirculation tank 30, by which a certain amount of used washing water or solvent can be transferred continuously or intermittently from the tank 29 when fresh water or solvent is supplied thereto, which transferred washing water or solvent was used for the last washing step. The water and the solvent are used in the tank 30 for the first washing step. The tank 30 has a spillway 34 for leading away used washing water or solvent, the direction of liquid flow being indicated by arrows in FIG. 4.

The device 28 can also be vertically positioned, so that the treated object is passed through the device in a vertical direction.

Means for heating or cooling of the circulating liquid can be provided.

The present device can with advantage be used for the treatment of a strip, wire, rod, bar or fibers, and size and configuration of the device must be adapted to the shape and the dimensions of the object 6. Other combinations involving the recirculation of the liquid and the solvent (the washing agent) than have been mentioned and discussed above or than have been shown in the drawing can be provided without deviating from the basic idea of the invention, so that a plurality of alternative embodiments of the device according to the invention can be attained.

To further illustrate the invention, the following example for treating wire is given.

EXAMPLE

A device according to the present invention was used for stripping off, washing and drying of stainless steel wire following a continuous electrochemical smoothing in strong acid solutions of mineral acid where the stainless steel wire had diameters between 0.60 and 4.0 mm, with the following conditions and results.

| For a 0.80 mm diameter wire: | |
|---|---|
| Wire speed | 20 meters per minute |
| Amount of washing water | 16 liters per minute per wire |
| pH of unused washing water | 6.8 |
| pH of used washing water | 3.5 |
| Water flow recirculating through the jet nozzle | 25 liters per minute |
| Sectional area of injection ducts | $2 \times 2 = 4$ mm$^2$ |
| Number of injection ducts in a circular form with equal angular distribution | 8 |
| Impinging angle of the injection ducts against the object being treated | 25° |
| Diameter of the expansion chamber, narrow end | 20 mm |
| Diameter of the expansion chamber, wide end | 51 mm |
| Rear end diameter of the duct in the jet nozzle | 3 mm |
| Length of the duct in the jet nozzle | 120 mm |

The pH-value of the used washing water depends on the number of washing steps, which in the present example consisted of two steps. As the result of the treatment, the wire was very well-cleaned, and was completely dry about 250 mm outside the wire outlet in the inlet assembly. The distance of 250 mm corresponds herein to an exposure to atmosphere of about 0.5 seconds.

What I claim is:

1. A method for cleaning an elongated object which has been surface-treated at a station with a fluid medium, comprising:

a. continually moving the object in a direction along its length through a subsequent first station;

b. continually spraying the entire periphery of the object as it passes through said first station with a liquid of substantially the same kind as said fluid medium, all the spray being directed counter to said direction of movement, and recirculating the sprayed liquid;

c. thereafter, at least partially drying the object with air moving in said first station in an opposite direction, and separating the used air from the liquid about to be recirculated;

d. thereafter repeating steps (b) and (c) in at least one subsequent second station, each time using and recirculating a more diluted form of said liquid;

e. selectively transferring some of the recirculated liquid to the next preceding station; and f. said liquid, in the last station, substantially comprising a solvent forming a part of said fluid medium.

2. A method according to claim 1 in which said drying comprises: by means of said spraying of liquid, forming a partial vacuum around the sprayed object, thereby sucking in drying gas around the object as it is guided out of the spraying station.

3. A method according to claim 1, the sprayed liquid emanating from a series of orifices and forming a coherent curtain impinging the surface of the object at an angle.

4. Apparatus for cleaning an elongated object which has been surface-treated at a station with a fluid medium, comprising:

a. a fluid-inlet assembly having a multiple jet nozzle upstream of a venturi, said inlet assembly having a passage extending therethrough with a cross-section larger than that of the object for enabling the intake of drying gas as the object is passed therethrough in an object-feeding direction, all the jets of said nozzle being directed for guiding liquid through air into impingment with the object at an angle having a vector opposite to said feeding direction;

b. means for supplying liquid to said jet nozzle of substantially the same type as said fluid medium; and c. a discharge assembly connected to said fluid inlet assembly in which moist air and liquid are separated, having an outlet from which moist air is vented to the atmosphere, having a separate outlet through which liquid injected from said jet nozzle is removed, and through which assembly the object passes to said passage.

* * * * *